US005553659A

United States Patent [19]

Hegel et al.

[11] Patent Number: 5,553,659

[45] Date of Patent: Sep. 10, 1996

[54] DIE CASTING MACHINE WITH SAFETY BAR

[75] Inventors: Robert W. Hegel, Holland; Melvin C. Hawke, Norton Shores; William P. Damian, Holland; Jon R. Mullen, West Olive, all of Mich.

[73] Assignee: Prince Machine Corporation, Holland, Mich.

[21] Appl. No.: 370,209

[22] Filed: Jan. 9, 1995

[51] Int. Cl.[6] ..... B22D 17/20

[52] U.S. Cl. ..... 164/153; 164/312; 425/151

[58] Field of Search ..... 164/312, 342, 164/152, 153, 113; 425/151, 451.2, 451.5, 590, DIG. 45

[56] References Cited

U.S. PATENT DOCUMENTS 3,359,598 12/1967 Bucy .
3,465,387 9/1969 Allard et al. .
4,340,346 7/1982 Hehl .
4,373,890 2/1983 Hehl .
4,737,093 4/1988 Hori et al. .
5,277,568 1/1994 Hirata et al. .

FOREIGN PATENT DOCUMENTS 3-286825 12/1991 Japan ..... 164/152

*Primary Examiner*—Kuang Y. Lin
*Attorney, Agent, or Firm*—Price, Heneveld, Cooper, DeWitt & Litton

[57] ABSTRACT

A metal die casting machine having a safety bar mechanism for cushioning the stopping action of a movable platen when it is stopped prior to reaching the closed position of the dies. One embodiment provides a two-part bar connected together by a cushioning means. A second embodiment mounts a cushioning means on one of the platens, preferably the movable platen.

27 Claims, 6 Drawing Sheets

DIE CASTING MACHINE WITH SAFETY BAR

BACKGROUND OF THE INVENTION

The present invention relates to metal die casting machines and particularly, to a metal die casting machine having a unique safety bar mechanism for cushioning the stopping action of a movable platen for emergency or other reasons before the movable platen reaches the closed position of the dies.

In die casting machines, it has been the general practice to provide a safety bar which is connected to the movable platen and extends rearwardly to the rear or back platen. At the back platen, the safety bar has a plurality of transverse grooves spaced along the rear end of the bar which slides over the back platen as the movable platen is moved forwardly or rearwardly. A safety bar cylinder is mounted on the rear platen over the safety bar. The safety bar cylinder actuates a safety bar blade, which upon response to some emergency or other reasons for stopping the movable platen, is actuated by the safety bar cylinder into one of the grooves to immediately stop the movement of the movable platen.

In the operation of these safety bars, a problem has occurred because the inertial forces generated by movement of the movable platen and the sudden stopping thereof presents an energy dissipation problem, particularly on the larger die casting machines which, for example, might be in the order of 2,000 to 4,000 tons, such used to cast engine blocks or the like. The sudden stopping of the movable platen jars the entire machine creating havoc on all the components of the die casting machine requiring constant repair of the same.

In the smaller ton machines, the inertial forces generated by the movement of the movable platen and sudden stopping thereof can be counteracted by strengthening the machine pans and components. However, on greater sizes of die casting machines, the strengthening of the machine parts and components is nearly impossible and at least impractical. Therefore, there has been a long-felt need to provide some way in which this problem of the breaking down of the parts and components of die casting machines caused by the inertial forces generated by sudden stopping of the movable platen can be solved.

SUMMARY OF THE INVENTION

The apparatus of the present invention satisfies this need by providing cushioning mechanisms to absorb the inertial forces generated by the movement of the movable platen toward the front platen as it is being stopped.

In one embodiment of the present invention, we provide a unique safety bar mechanism that includes a first bar part and a second bar part connected together by a cushioning mechanism. In this preferred embodiment, a first part of the bar is connected at one end to the movable platen. The second part includes an end which slides over the back or front platen and is selectively connected to the rear or front platen by a safety blade mechanism which is actuated in response to one of a number of predetermined conditions for stopping the movement of the movable platen. The other ends of the first and second parts are connected together by a cushioning mechanism which cushions the relative movement of the two bar parts and thus cushions the stopping movement of the movable platen so as to absorb or dissipate the energy generated by the movable platen.

In accordance with another embodiment of our invention, a cushioning mechanism is mounted on one of the movable platen or one of the rear or front platens so as to absorb the inertial forces or energy generated by the movement of the movable platen as it is being stopped. In accordance with this embodiment, we disclose only the mechanism being mounted on the movable platen, which is preferred, although it is well within the skill of the art to mount the cushioning mechanism on one of the front or rear platens, which obviously would require a so-called safety blade box to be mounted on the movable platen.

In this latter embodiment, a limited sliding action between the safety bar and the platen on which the cushioning mechanism is mounted is provided. In this embodiment, a cushioning element of the cushioning mechanism is engageable by the sliding connection between the safety bar and the platen so as to cushion the sliding movement between the safety bar and the platen on which the cushioning mechanism is located.

With either of the two embodiments as disclosed in this application and any equivalents thereof, the need for providing some means to eliminate the adverse effect of the inertial forces generated by the movable platen as it is stopped is provided. These and other features, advantages, and objects of the present invention will be best understood by reference to the following description thereof together with the drawings in which:

DETAILED DESCRIPTION OF THE PREFERRED EMBODIMENTS

Figure 1:
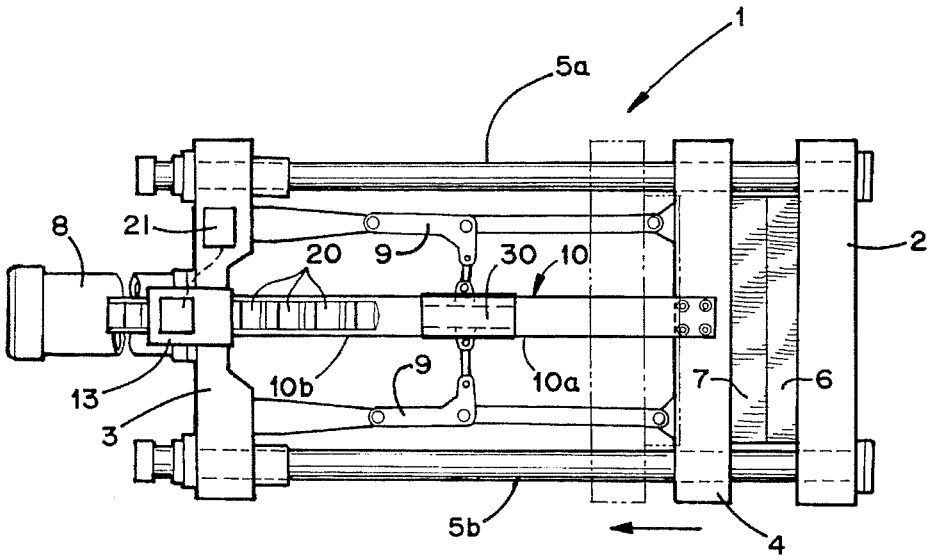
FIG. 1 is a simplified plan view of a die casting machine incorporating one embodiment of the present invention.

Referring to FIG. 1, reference numeral 1 designates a die casting machine which includes the front platen 2, a rear platen 3, and a movable platen 4 positioned between the front and rear platens and movable therebetween on the tie bars 5*a* and 5*b*, therebeing only two shown but it being understood that there are four such tie bars connected at the corners of both the from platen 2 and the rear platen 3 over which the movable platen 4 is movable.

A half die 6 is mounted on the rearward facing surface of the front platen 2 while the corresponding mating die half 7 is mounted on the front surface of the movable platen 4.

The die casting machine 1 includes a hydraulic cylinder 8 that drives a toggle mechanism 9 extending between the rear platen 3 and the movable platen 4 for advancing the movable platen 4 into a locked-up, closed casting position and for retracting the movable platen 4 away from the front platen 2 for opening the die for removal of the cast part. The die casting machine 1 is of the same general type as that disclosed in U.S. Pat. No. 3,407,685 assigned to the present assignee and the disclosure of which is incorporated herein by reference.

Figure 2:
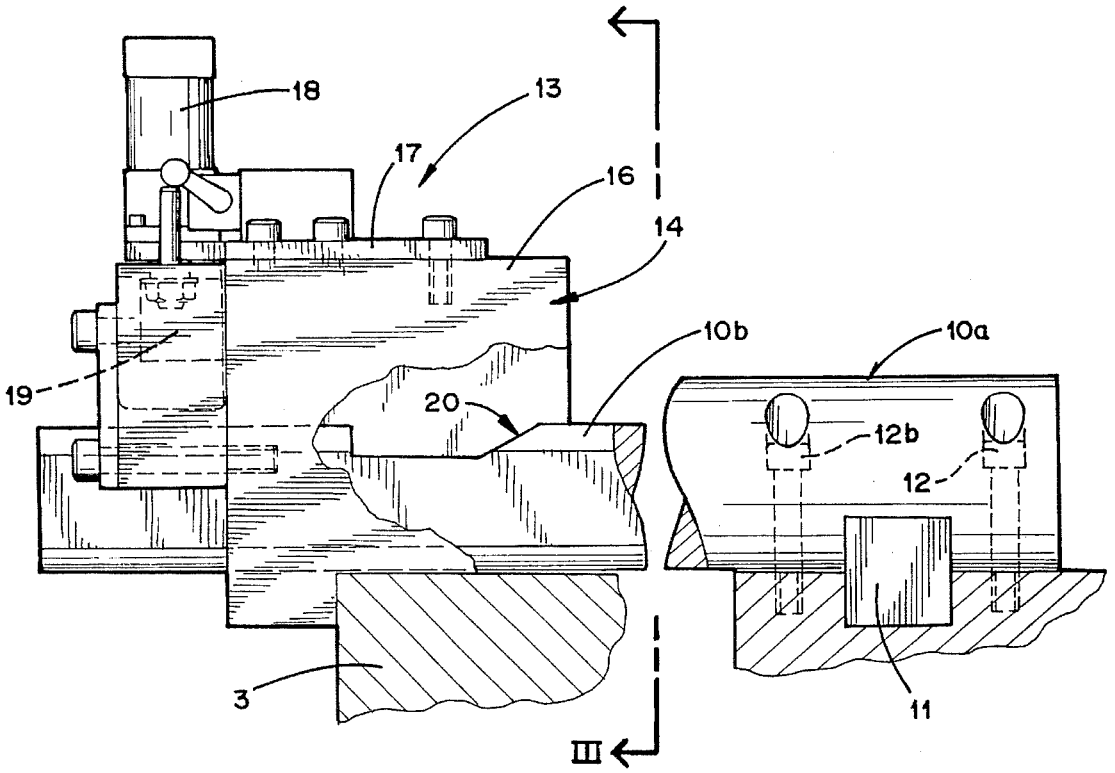
FIG. 2 is an enlarged, side-elevational view of the mounting of the safety bar on the movable and rear platen as disclosed in the plan view of FIG. 1.
Figure 3:
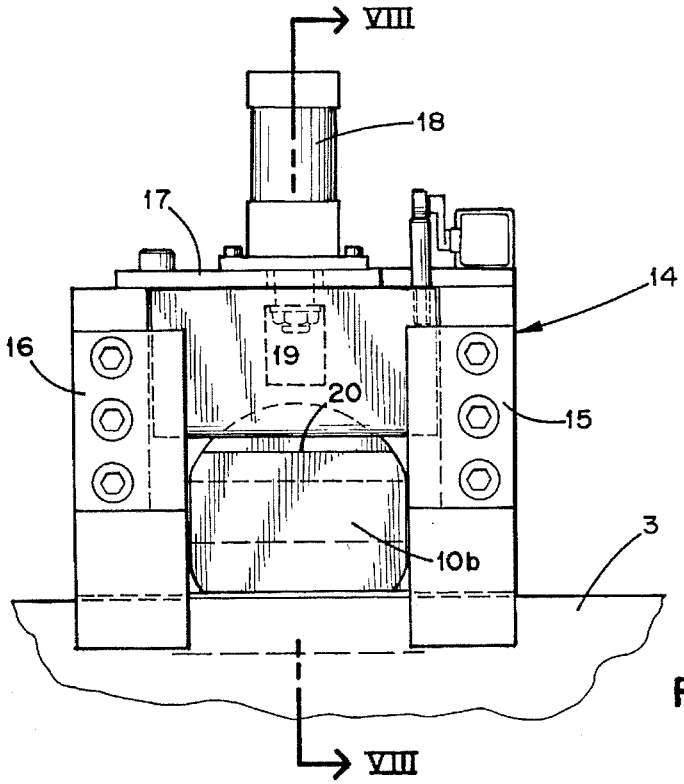
FIG. 3 is a view taken along the plane III—III of FIG. 2.
Figure 4:
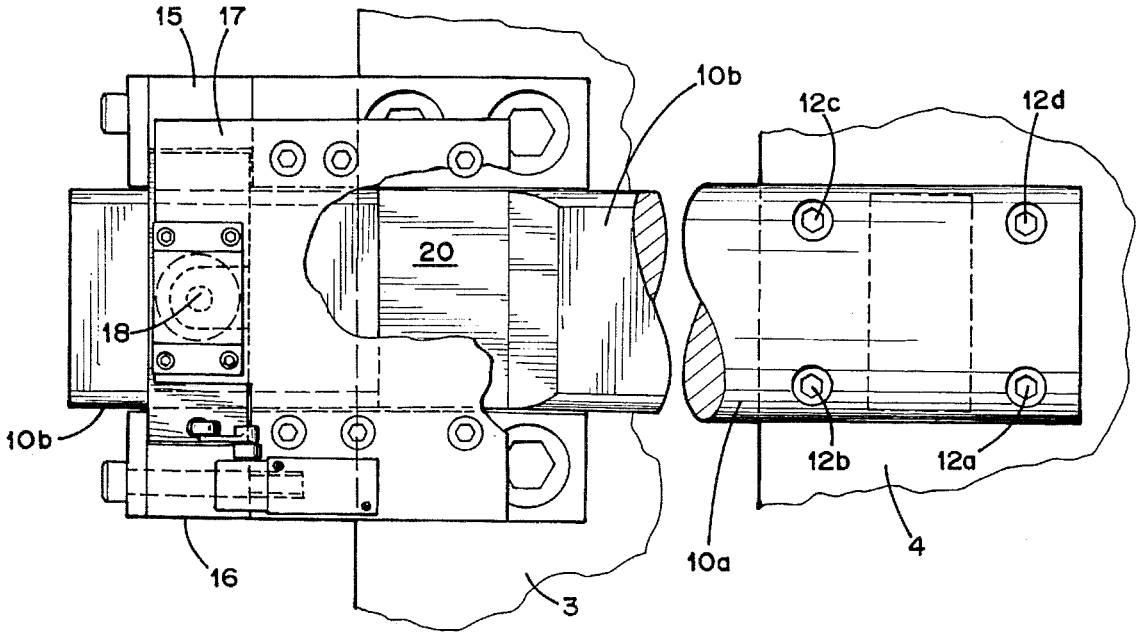
FIG. 4 is a plan view of the mechanism as disclosed in FIG. 2.

A safety bar 10 comprising a forwardly extending part 10*a* and a rearwardly extending part 10*b* extends between the movable platen 4 and the rear platen 3. Part 10*a* is attached to the movable platen 4 by the support key 11 and four bolts 12*a*, 12*b*, 12*c*, and 12*d* as disclosed in FIGS. 2 and 4. As disclosed in FIGS. 1–4, the part 10*b* of safety bar 10 extends over the rear platen 3 and through which will be referred to as a safety blade box 13. Safety blade box 13 includes a tower 14 constructed of two, spaced, upright support members 15 and 16 spaced across the rear platen 3 a predetermined distance to receive and guide the rear end of part 10*b* of safety bar 10. Extending between and over the tops of the two support members 15 and 16 is a support plate 17 supporting a safety bar cylinder 18 provided to actuate the safety bar blade 19. As will be noted from FIGS. 1–6, the end of the safety bar 10 includes a plurality of notches 20 which, in cooperation with the safety blade 19, provides a means for stopping the movement of the movable platen 3.

The pneumatic safety bar cylinder 18 is actuated in response to a signal from a control system 21. Since the control system 21, which causes actuation of the safety bar cylinder 18, is well known in the art, it is not considered necessary to disclose the details of the control system 21 or how it operates to actuate the safety bar cylinder 18. Suffice it to say that the actuation of safety bar cylinder 18 is responsive to several different conditions, such as when an operator perceives a dangerous situation, or the computer, which controls the machine, senses a wrong sequence, so as to stop the movement of movable platen 4.

Having described the environment in which the present invention is incorporated, reference is now made to FIGS. 5–8 wherein one of the cushioning mechanisms of this invention is disclosed. In this embodiment, the cushioning mechanism is incorporated within the safety bar 10 by providing a safety bar comprised of two parts 10*a* and 10*b* connected together by the cushioning mechanism 30, the details of which are disclosed in FIGS. 7 and 8.

Figure 5:
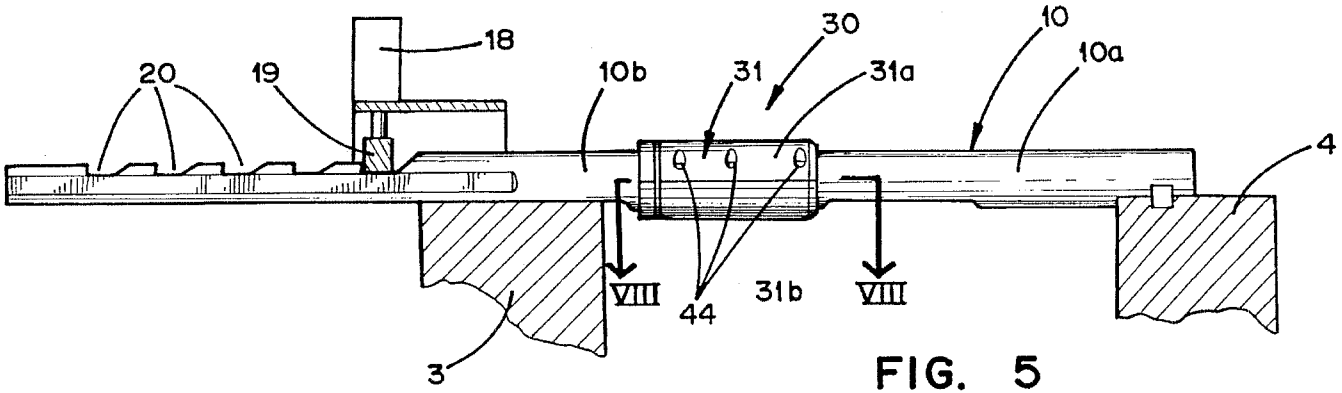
FIG. 5 is a side-elevational view of the safety bar of this invention mounted on the from and rear platen with the safety blade actuated for stopping the movable platen.
Figure 6:
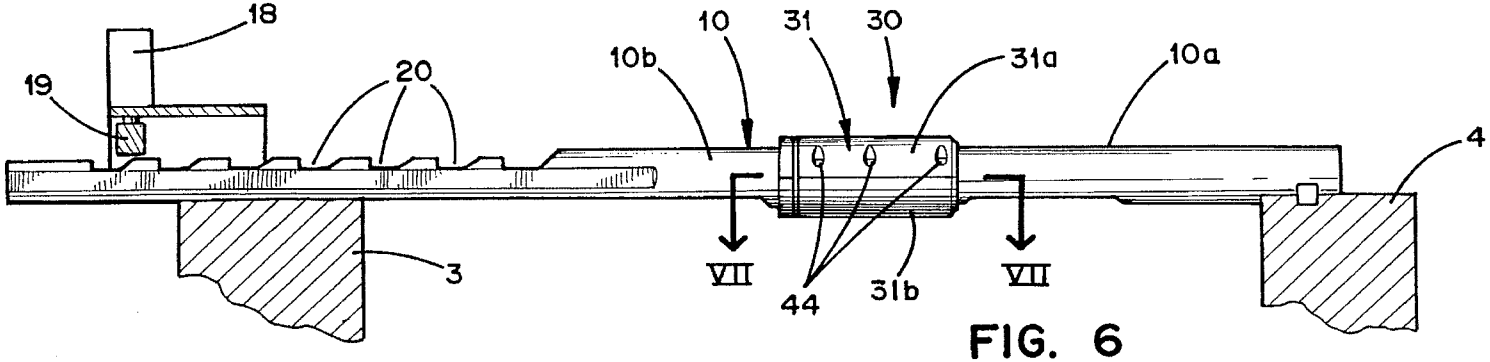
FIG. 6 is a side-elevational view of the safety bar of this invention as disclosed in FIG. 5 but with the moveable platen in closed position.
Figure 7:
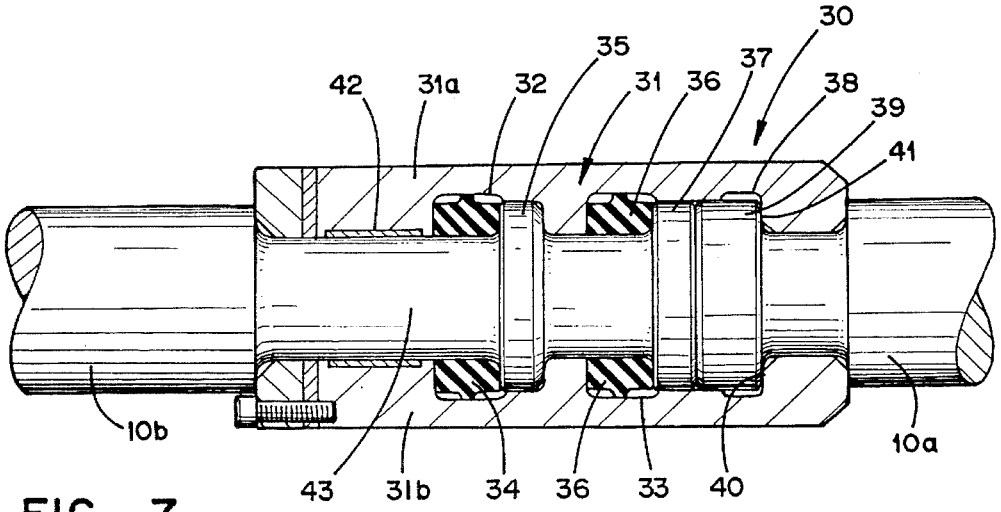
FIG. 7 is a cross-sectional view taken along the plane VII—VII of FIG. 6 of the cushioning mechanism of this invention as disclosed in FIGS. 1–6.
Figure 8:
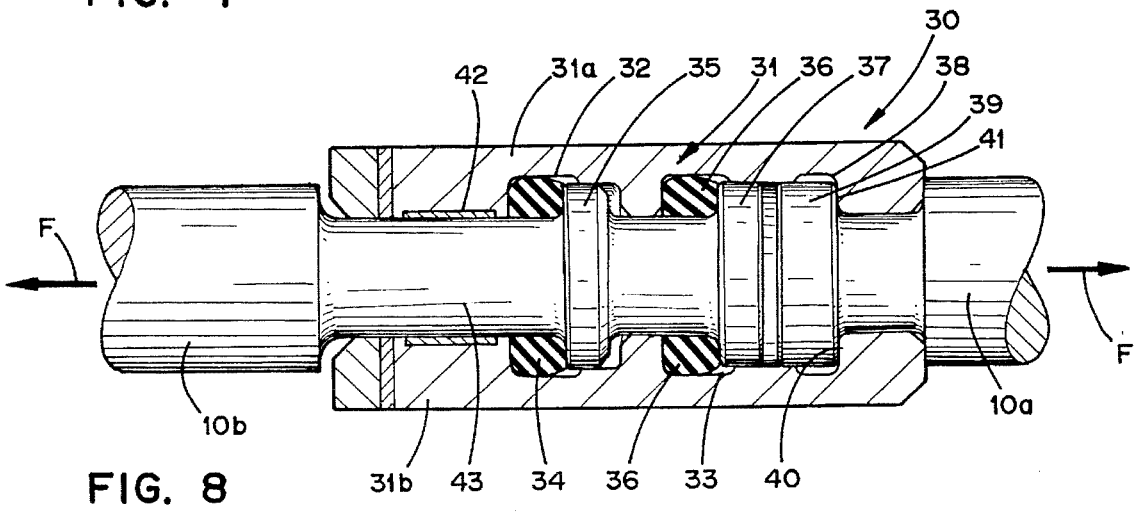
FIG. 8 is a cross-sectional view taken along the plane VIII—VIII of FIG. 5 of the cushioning mechanism of this invention as disclosed in FIGS. 1–5 showing the cushioning means deflected as would occur when the safety blade engaged the safety bar while the moveable plate was moving.

Before describing the cushioning mechanism 30 in conjunction with FIGS. 7 and 8, reference is first made to FIGS. 5 and 6 of which FIGS. 7 and 8 are cross sections. FIG. 5 discloses the safety bar in locked position, that is, in a position where the safety bar has stopped movement of the movable platen 4. As illustrated in FIG. 5, stopping the movement of the movable platen 4 is accomplished by actuation of safety bar cylinder 18 which forces safety bar blade 19 into one of the notches 20 which immediately stops movement of bar part 10*b* and eventually bar part 10*a* and front plate 4. In prior art machines, this would create a tremendous inertial force on the bar 10 causing a jarring which is transmitted to the components and parts of machine 1. In accordance with the present invention, a force F is exerted by the moving platen 4 on bar part 10*a*. This creates a counteracting force F1 on the part 10*b* of the bar 10. As will be explained hereinafter, these opposing forces F and F1 are absorbed to a great extent by cushioning mechanism 30.

FIGS. 7 and 8 disclose the cushioning mechanism 30 connecting the two parts 10*a* and 10*b* of the safety bar 10. Cushioning mechanism 30 comprising a housing formed by a split collar 31 which include collar parts 31*a* and 31*b* connected together by bolts 44 (FIGS. 5 and 6). Collar 31 includes the three recesses 32, 33, and 38. Cushioning element or bumper 34 and an enlarged flange 35 of the bar part 10*b* are located in the recess 32 while the bumper 36 and the enlarged flange 37 of the part 10*b* are located in the recess 33. Bumpers 34 and 36 are doughnut-shaped elements constructed of a urethane plastic. Enlarged flange 39 of the bar part 10*a* is located in recess 38 which includes a shoulder 40 against which the shoulder 41 of the enlarged flange 39 abuts.

It should be evident from FIG. 7 that in the rest position of FIG. 6, the bumpers 34 and 36 are not compressed. However, when force F is exerted on part 10*a* of bar 10 by platen 4, bar part 10*a* pulls collar 31 in the direction of the force F so as to cause enlarged flanges 35 and 37 to compress bumpers 34 and 36, respectively. Bearing guide 42 is provided to guide the neck 43 of the bar part 10*b*.

OPERATION OF THE FIRST EMBODIMENT

Having described the details of the structure of the first embodiment of this invention as disclosed in FIGS. 1–8, the operation of this first embodiment should be evident.

Referring to FIG. 1, and assuming that the movable platen 4 is in open position represented by the phantom lines, the dies 6 and 7 are spaced from each other. Then, assume the hydraulic actuator cylinder 8 along with the toggle mechanism 9 is moving the movable platen 4 toward the front platen 2. The control system 21 may sense a condition which mandates the stopping of the movable platen 4 before it reaches the closed position of FIG. 1. Upon such a condition, control system 21 immediately causes actuation of the safety bar cylinder 18 which forces the safety bar blade 19 into one of the grooves 20 (FIG. 5). This immediately locks the bar part 10*b* of the bar 10 into a stationary position. With previous safety bars, the platen 4 would also immediately stop generating inertial forces which jarred the entire machine and created havoc with the parts and components of the entire machine. In accordance with this invention, the movable platen 4 is permitted to move a predetermined distance during which the cushioning mechanism 30 absorbs the inertial forces. This is accomplished by the part 10*a* of the bar 10 pulling the housing comprising the collar 31 in the direction of the force F as disclosed in FIG. 8. This causes the enlarged, circular flanges 35 and 37 of bar part 10*b* to engage and compress the bumpers 34 and 36 thus absorbing the inertial forces generated by the movable platen 4 as it is being stopped.

DESCRIPTION OF THE SECOND EMBODIMENT

Figure 9:
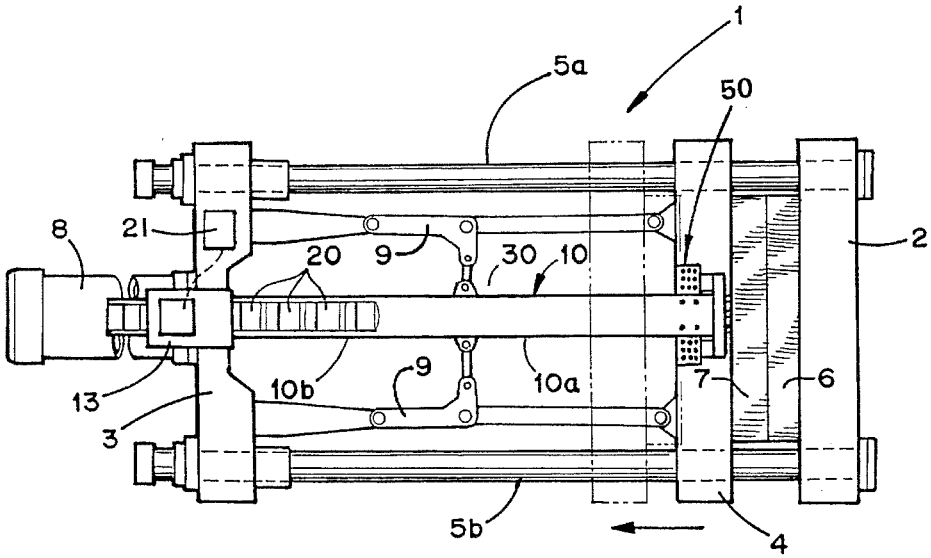
FIG. 9 is a plan view of a die casting machine incorporating another embodiment of a cushioning mechanism for the safety bar.

FIGS. 9–14 are different from that disclosed in FIGS. 1–8 by substituting the cushioning mechanism 50, shown in FIG. 9, for the cushioning mechanism 30. FIG. 9 discloses cushioning mechanism 50 mounted on the movable platen 4 although with minor changes it is well within the skill of the art to mount the cushioning mechanism 50 on either the front platen 2 or the rear platen 3 in which event the safety blade box assembly 13 would be mounted on the movable platen 4. It is preferable that the cushioning mechanism is mounted on the movable platen 4.

FIG. 9 is almost identical to that of FIG. 1 and discloses all the parts thereof except the safety bar cushioning mechanism 30 which has been replaced by the cushioning mechanism 50 mounted on the movable platen 4. Thus, the safety bar 10A is a single piece extending from the rear platen 3 to the movable platen 4 wherein it has a limited sliding action as will now be described in relation to FIGS. 10–14.

Figure 10:
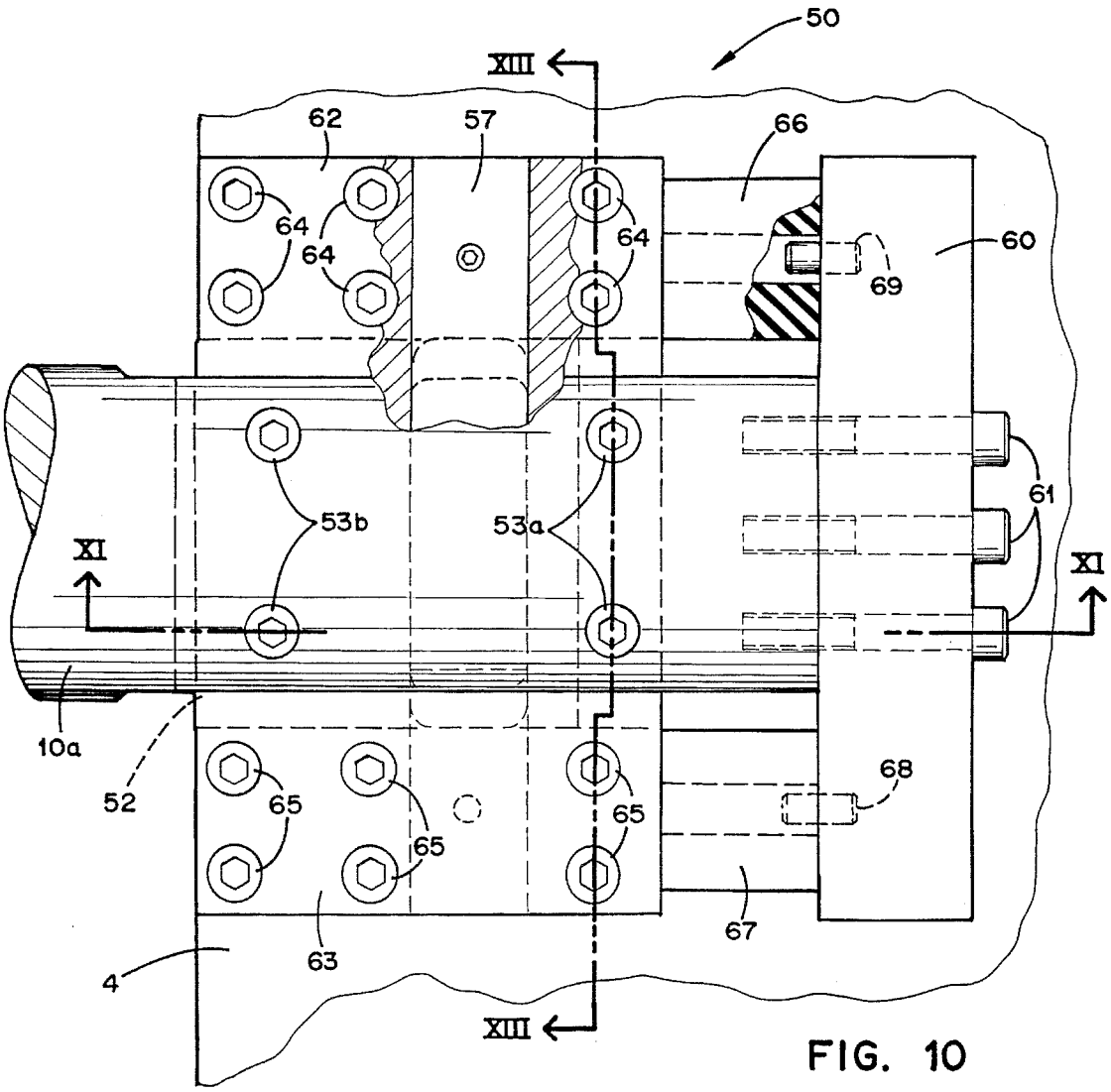
FIG. 10 is a plan view of the cushioning mechanism mounted on the front platen as disclosed in FIG. 9 showing cushioning means in a non-deflected state.
Figure 11:
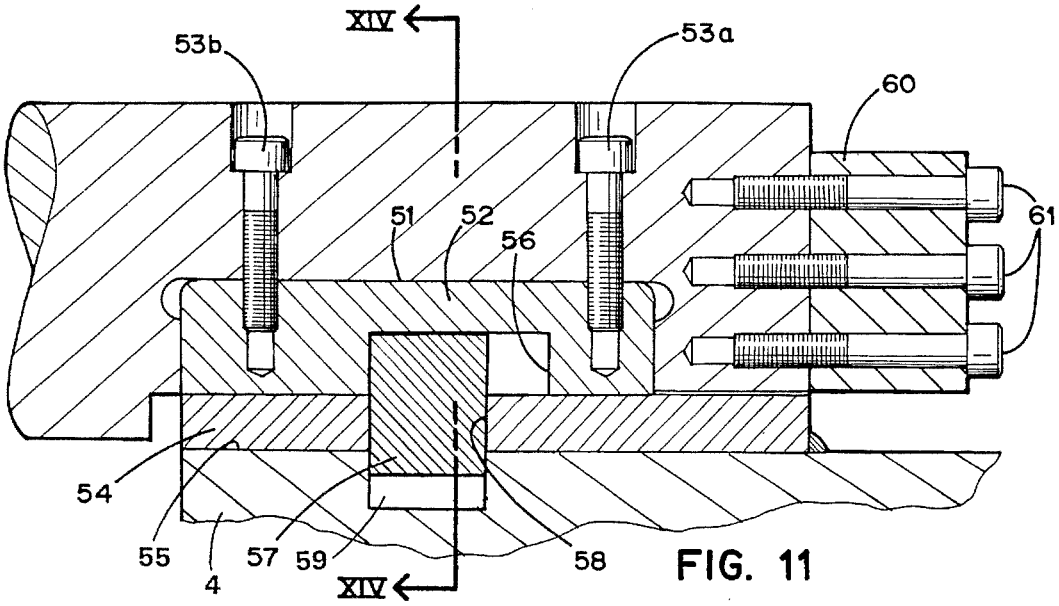
FIG. 11 is a cross-sectional view taken along the plane XI—XI of FIG. 10.

As disclosed in FIGS. 10–14, the safety bar 10A includes a transverse groove 51 in which is located the slide plate 52 secured to the safety bar 10A by the bolts 53*a* and 53*b*. A second slide or weld plate 54 is welded on the top face 55 of the platen 4 so that as disclosed in FIG. 11, relative slidable movement is permitted between the plates 52 and 54. Thus, relative slidable movement between safety bar 10A and movable platen 4 is provided. The structure for providing such limited sliding movement is best shown in FIG. 11, which includes a groove 56 cut into the bottom surface of slide plate 52 into which extends a key 57 extending through an opening 58 in the slide plate 54 and into a groove 59 in the top face of movable platen 4. Thus, a limited sliding movement between the movable platen 4 and the safety bar 10A is provided as illustrated by a comparison of the position of key 57 in groove 56 as disclosed in FIGS. 11 and 12.

Figure 13:
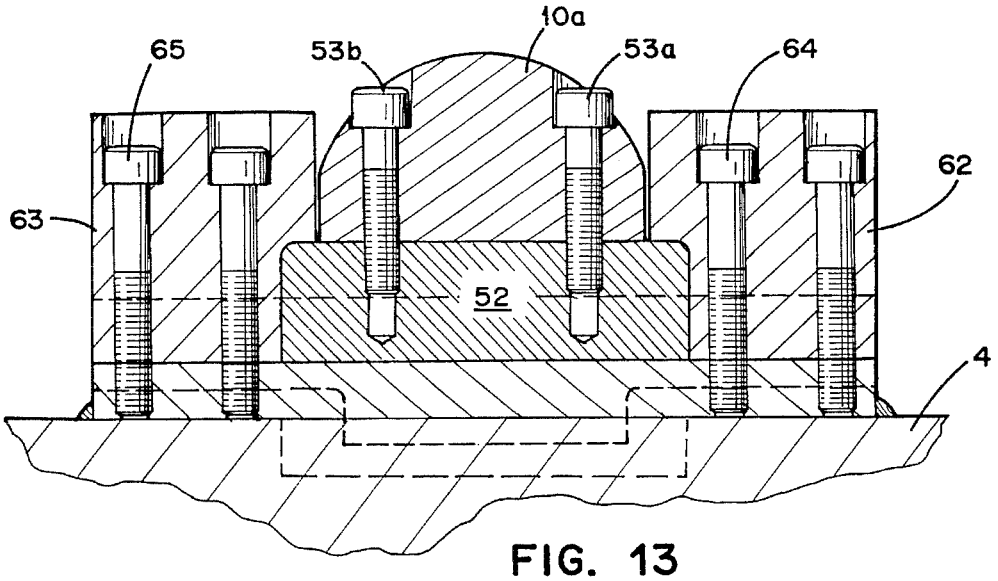
FIG. 13 is a cross-sectional view taken along the plane XIII—XIII of FIG. 10.
Figure 14:
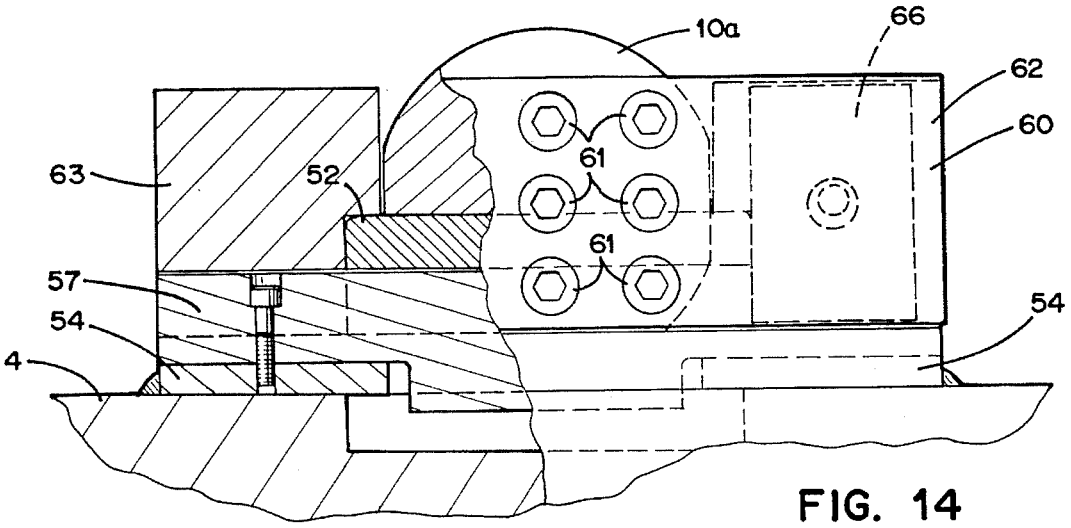
FIG. 14 is a cross-sectional view taken along the plane XIV—XIV of FIG. 11.

An end plate 60 is secured to the extreme end of the safety bar 10A by means of a plurality of bolts 61. Safety bar 10A is guided by L-shaped gibs 62 and 63 secured to the slide plate 54, and thus to platen 4, by the bolts 64 and 65 as best illustrated in FIG. 13. The L-shaped gibs 62 and 63 capture the slide plate 52 and provide a sliding connection between safety bar 10A and platen 4 which guides the sliding movement of the safety bar 10A.

Figure 12:
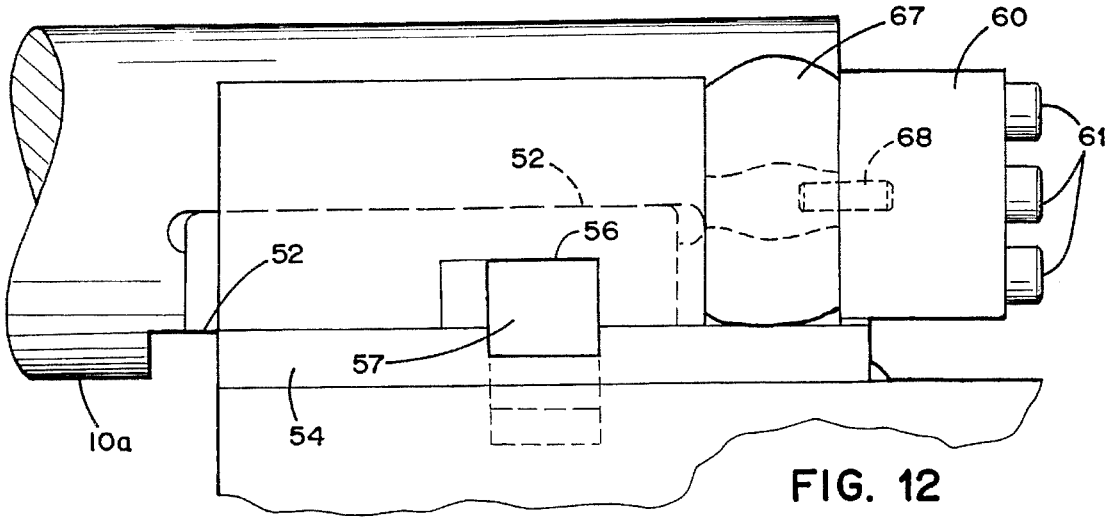
FIG. 12 is a side-elevational view of the cushioning mechanism of FIG. 10 showing the cushioning means in a deflected state as would occur when the safety blade engaged the safety bar while the moveable plate was moving.

As best disclosed in FIGS. 10 and 12, the L-shaped gibs 62 and 63 are spaced from the end plate 60 and provide abutments for compressing the resilient bumpers 66 and 67 which are located between the gibs 62 and 63 and the end plate 60, respectively, and are held in place by the locating dowels 68 and 69. Bumpers 66 and 67 are constructed of a urethane plastic thereby providing cushioning means as the movable platen 4 slides relative to the safety bar 10A from the position of FIG. 11 to the position of FIG. 12 and gibs or abutments 62 and 63 compress bumpers 66 and 67.

OPERATION OF THE SECOND EMBODIMENT

Having described the second embodiment as disclosed in FIGS. 9–14, the operation for cushioning the stopping of the movable platen 4 by the cushioned safety bar 10A should be evident. As previously described, the control system 21 on sensing a particular condition while the platen bar is moving, actuates the safety bar cylinder 18 causing the safety bar blade 19 to engage in one of the notches 20 of the safety bar 10A. In prior art structures, this would normally immediately stop the movement of the movable platen 4 and create a jarring action on all of the components of the die casting machine. With this particular embodiment of this invention, after the safety bar blade 19 engages a notch of the safety bar, the movable platen 4 is permitted to continue to slide a limited distance relative to the end of the safety bar 10A. This limited distance is governed by the engagement of key 57 on the frontward wall of the groove 56 (FIG. 12). During this continued movement of the movable platen after blade 19 engages one of the notches 20, the gibs 62 and 63, which move with the movable platen 4, perform as abutments to compress the bumpers 66 and 67 as illustrated in FIG. 12, thus providing a cushioning means during the stopping action of the movable platen 4.

Having described the two embodiments of our invention, it should become evident that this invention has solved the problem of the adverse effect upon the components and parts of the die casting machine caused by the inertial forces created by the sudden stopping of the movable platen prior to it reaching the closed position. It also should be understood that although the preferred embodiments of the present invention are disclosed, these and various other modifications thereto will become apparent to those skilled in the art and will fall within the spirit and scope of the invention as defined by the appended claims.

The embodiments of the invention in which an exclusive property or privilege is claimed are defined as follows:

1. In a die casting machine having a front platen, a rear platen, a movable platen located between said front and rear platens, an actuator for moving said movable platen between open and closed positions; and a safety bar mechanism operatively connected between said movable platen and said rear platen for stopping the movement of said movable platen short of said closed position as it is moving toward closed position; the improvement comprising:

a cushioning mechanism associated with said safety bar to absorb the inertial forces generated by the movement of said movable platen toward said front platen as it is being stopped.

2. The die casting machine of claim 1 in which said safety bar mechanism includes a bar having a first part and a second part connected together by said cushioning mechanism.

3. The die casting machine of claim 2 in which each of said first and second bar pans includes two ends; one end of said first part being connected to said movable platen; one end of said second part being selectively connected to said rear platen by an actuating mechanism in response to a predetermined condition for stopping the movement of said movable platen; the other ends of said first and second parts being connected together by said cushioning mechanism.

4. The die casting machine of claim 3 in which said cushioning mechanism includes a housing in which said other ends are located; said housing having at least one cushioning element arranged to cushion the relative movement of said first and second parts.

5. The die casting machine of claim 4 in which said first part is connected to said housing for moving said housing relative to the other end of said second part in response to the inertial force generated by said movable platen; said housing containing said cushioning element which engages said other end of said second part to cushion the relative movement of said first and second part.

6. The die casting machine of claim 5 in which said housing is a collar having at least one inner recess in which said cushioning element is located; and said second part having at least one flange forming a shoulder engaging said cushioning element and compressing the same upon relative movement between said collar and said second part.

7. The die casting machine of claim 6 in which said cushioning element is doughnut shaped thereby having a central opening; said second part having a portion extending through said opening and said flange having a circular cross section and formed integral with said portion.

8. The die casting machine of claim 6 in which said collar includes a plurality of recesses; said second part having a plurality of spaced circular flanges, one located in each of said recesses; and a plurality of cushioning elements, one located in each of said recesses.

9. The die casting machine of claim 8 in which each of said cushioning elements is doughnut shaped thereby having a central opening; said second part having a plurality of portions, one portion extending through the opening of one of said doughnut-shaped cushioning elements and the other portion extending through the opening of another of said doughnut-shaped cushioning element whereby a shoulder of each of said flanges is adapted to engage and compress one of said cushioning elements.

10. A safety bar of a die casting machine for connection between a stationary platen and a movable platen of a die casting machine for stopping the closing movement of a movable platen, the improvement comprising said safety bar comprising two parts, each part having at one end a connecting mechanism for operatively connecting said bar to one of said platens; and each part at its other end operatively connected to a cushioning mechanism to absorb the inertial forces generated by the movement of said movable platen as it is being stopped.

11. The safety bar of claim 10 in which said cushioning mechanism includes a housing in which said other ends are located; said housing having at least one cushioning element arranged to cushion the relative movement of said first and second parts.

12. The safety bar of claim 11 in which said first part is connected to said housing for moving said housing relative to the other end of said second part in response to the inertial force generated by said movable platen; said housing containing said cushioning element which engages said other end of said second part to cushion the relative movement of said first and second part.

13. The safety bar of claim 12 in which said housing is a collar having at least one inner recess in which said cushioning element is located; and said second part having at least one flange forming a shoulder engaging said cushioning element and compressing the same upon relative movement between said collar and said second part.

14. The safety bar of claim 13 in which said cushioning element is doughnut shaped thereby having a central opening; said second part having a portion extending through said opening and said flange having a circular cross section and formed integral with said portion.

15. The safety bar of claim 13 in which said collar includes a plurality of recesses; said second part having a plurality of spaced circular flanges, one located in each of said recesses; and a plurality of cushioning elements, one located in each of said recesses.

16. The safety bar of claim 15 in which each of said cushioning elements is doughnut shaped thereby having a central opening; said second part having a plurality of portions, one portion extending through the opening of one of said doughnut-shaped cushioning elements and the other portion extending through the opening of another of said doughnut-shaped cushioning openings whereby a shoulder of each of said flanges is adapted to engage one of said doughnut-shaped cushioning elements.

17. In a die casting machine having a from platen, a rear platen, a movable platen located between said front and rear platens, an actuator for moving said movable platen between open and closed positions; and a safety bar mechanism operatively connected between said movable platen and said rear platen for stopping the movement of said movable platen short of said closed position as it is moving toward closed position; the improvement comprising:

a cushioning mechanism mounted on said one of movable platen and said rear platen to absorb the inertial forces generated by the movement of said movable platen toward said front platen as it is being stopped.

18. The die casting machine of claim 17 in which said cushioning mechanism includes a sliding connection mounted on said platen on which said cushioning mechanism is mounted, said sliding connection providing limited sliding movement between said safety bar and said platen on which said cushioning mechanism is mounted; said cushioning mechanism having at least one cushioning element engageable by said sliding connection to cushion said sliding movement between said safety bar and said platen on which said cushioning mechanism is located.

19. The die casting machine of claim 17 in which the cushioning mechanism is mounted on said movable platen.

20. The die casting machine of claim 18 in which the cushioning mechanism is mounted on said movable platen.

21. The die casting machine of claim 20 in which one of said bar and movable platen has a slot associated therewith and the other of said bar and movable platen has a protrusion associated therewith and extending into said slot thereby providing limited sliding movement between said bar and movable platen.

22. The die casting machine of claim 21 in which an end plate is attached to the end of said safety bar; said sliding connection including at least one abutment member attached to said movable platen and spaced from said end plate; and at least one cushioning element mounted between said end plate and said at least one abutment member.

23. The die casting machine of claim 18 in which the sliding connection includes a slide plate secured to said bar; said protrusion includes a key secured to said movable platen and protruding upwardly therefrom; said slide plate having a groove receiving said key and wider than said key permitting said key to slide in said groove.

24. The die casting machine of claim 22 in which the sliding connection includes a slide plate secured to said bar; said protrusion includes a key secured to said movable platen and protruding upwardly therefrom; said slide plate having a groove receiving said key and wider than said key permitting said key to slide in said groove toward said end plate.

25. The die casting machine of claim 22 in which said at least One abutment member includes two L-shaped members spacedly mounted on said movable platen and receiving said bar and slide plate therebetween for guiding the same.

26. The die casting machine of claim 22 in which the at least one cushioning element is a resilient bumper.

27. The die casting machine of claim 25 in which the at least one cushioning element includes a plurality of resilient bumpers located between said end plate and each of said L-shaped members.

* * * * *

UNITED STATES PATENT AND TRADEMARK OFFICE

CERTIFICATE OF CORRECTION

PATENT NO. : 5,553,659
DATED : September 10, 1996
INVENTOR : Robert W. Hegel et al.

It is certified that error appears in the above-identified patent and that said Letters Patent is hereby corrected as shown below:

Column 1, line 37;

"pans" should be –parts–.

Column 2, line 42;

"from" should be –front–.

Column 3, Line 17;

"from" should be "front".

Column 4, Lines 29 & 30;

delete Paragraph spacing.

UNITED STATES PATENT AND TRADEMARK OFFICE

CERTIFICATE OF CORRECTION

PATENT NO. : 5,553,659
DATED : September 10, 1996
INVENTOR : Robert W. Hegel et al.

It is certified that error appears in the above-identified patent and that said Letters Patent is hereby corrected as shown below:

Column 6, line 49;

"pans" should be –parts–.

Column 8, line 57;

"One" should be –one–.

Signed and Sealed this

Twenty-fifth Day of February, 1997

*Attest:*

*Attesting Officer*

BRUCE LEHMAN

*Commissioner of Patents and Trademarks*